US008572771B1

(12) United States Patent
Zhadanov et al.

(10) Patent No.: US 8,572,771 B1
(45) Date of Patent: Nov. 5, 2013

(54) DEVICE FOR SHOWERING

(71) Applicants: Eli Zhadanov, Brooklyn, NY (US); Sam Zhadanov, Brooklyn, NY (US)

(72) Inventors: Eli Zhadanov, Brooklyn, NY (US); Sam Zhadanov, Brooklyn, NY (US)

( * ) Notice: Subject to any disclaimer, the term of this patent is extended or adjusted under 35 U.S.C. 154(b) by 0 days.

(21) Appl. No.: 13/689,993

(22) Filed: Nov. 30, 2012

(51) Int. Cl.
*A47K 3/00* (2006.01)

(52) U.S. Cl.
USPC ..... 4/615

(58) Field of Classification Search
USPC ..... 4/615, 601, 605, 567, 568, 570; 239/273, 279, 282, 283
See application file for complete search history.

(56) References Cited

U.S. PATENT DOCUMENTS 5,833,192 A * 11/1998 Buhrman ..... 248/295.11
8,191,185 B2 * 6/2012 Tsai ..... 4/601
2006/0242759 A1 * 11/2006 Tsai ..... 4/605

* cited by examiner

*Primary Examiner* — Huyen Le
(74) *Attorney, Agent, or Firm* — Henry M. Feiereisen, LLC

(57) ABSTRACT

A device for showering includes a water diverter connectable to a source of water, an overhead showerhead connected with the diverter and a hand-held showerhead connected with said diverter so that the diverter can direct water to the overhead showerhead or to the hand-held showerhead, and a rod-shaped element which is held by the diverter and is provided with a supporting member supporting the hand-held showerhead in a position of non-use.

5 Claims, 2 Drawing Sheets

DEVICE FOR SHOWERING

BACKGROUND OF THE INVENTION

The present invention relates to devices for showering, in particular including an overhead showerhead and a hand-held showerhead, which can be used alternatingly as desired by users.

Devices for showering of the above mentioned general type are known in the art. In the known devices for showering, a diverter to which both the overhead showerhead and the hand-held showerhead are connectable is adjustable by a user, so as to direct water to a respective one of the showerhead. It is believed that the devices for showering of this type can be further improved in regard to support and orientation of the parts of the device.

SUMMARY OF THE INVENTION

Accordingly it is an object of the present invention to provide a device for showering, which is a further improvement of the existing devices.

In keeping with these objects and with others which will become apparent hereinafter, one feature of the present invention resides, briefly stated, in a device for showering, which has a water diverter connectable to a source of water; an overhead showerhead connected with said diverter and a hand-held showerhead connected with said diverter so that said diverter can direct water to said overhead showerhead or to said hand-held showerhead; and a rod-shaped element which is held by said diverter and is provided with a supporting member supporting said hand-held showerhead in a position of non-use.

In accordance with another feature of the present invention, the diverter has an axis and a portion supporting said rod-shaped element and turnable around said axis so that said rod-shaped element supported by said supporting portion is also turnable around said axis of said diverter.

A further feature of the present invention is that said rod-shaped element is elongated, and said supporting member is displaceable on said rod-shaped element in a direction of its elongation and fixable in a plurality of positions spaced from one another in the direction of elongation.

Still a further feature of the present invention is that in the inventive device said supporting portion of said diverter has an engaging part which engages and holds a part of said hand-held showerhead and a main part having an opening through which said rod-shaped element passes from below and which is substantially conical; and a substantially conical plug is tightly insertable into said opening and fittable on an end of said rod-shaped element to firmly hold said rod-shaped element in said supporting portion of said diverter.

In the inventive device for showering said diverter can have a portion which alternatingly can receive in it either a part of said rod-shaped element or a portion of said hand-held showerhead to support correspondingly either said rod-shaped element or said hand-held showerhead The novel features of the present invention are set forth in particular in the appended claims. The invention itself, however, both as to its construction and its manner of operation, will be best understood from the following description of the preferred embodiments, which is accompanied by the following drawings.

DESCRIPTION OF THE PREFERRED EMBODIMENTS

Figures 1, 2:
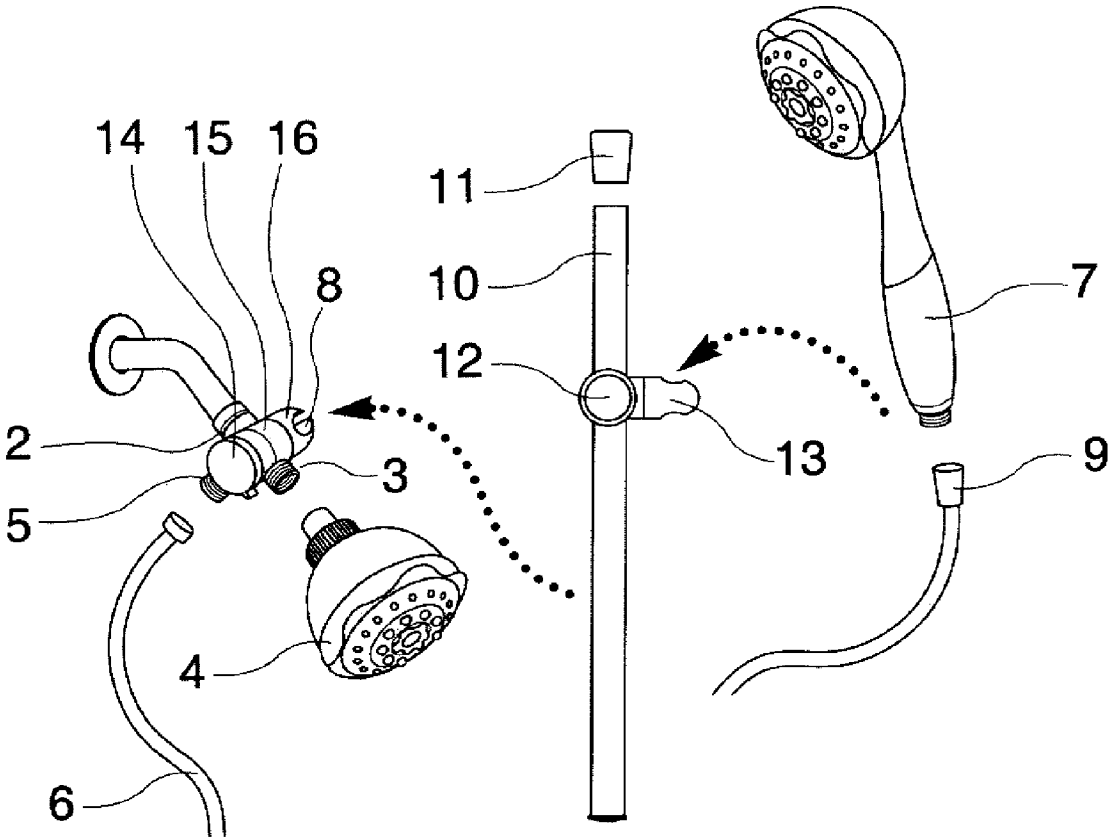
FIG. 1 of the drawings is a view showing a water diverter and an overhead showerhead of the inventive showering system.
FIG. 2 is a view showing a hand-held showerhead and a rod-shaped element of the inventive showerhead system.

A device for showing in accordance with the present invention has a diverter 1 which is connectable to a source of water, for example by a lock nut 2. The diverter 1 has a first outlet 3 for connecting an overhead showerhead 4, for example by interengaging threads, and a second outlet 5 for connecting a hose 6 of a hand-held shower 7, for example by threads as well. By turning a portion 14 of the diverter 1 around its axis, the water can be directed either to the overhead showerhead 4 or to the hand-held showerhead 7, as know in the art.

Figure 3:
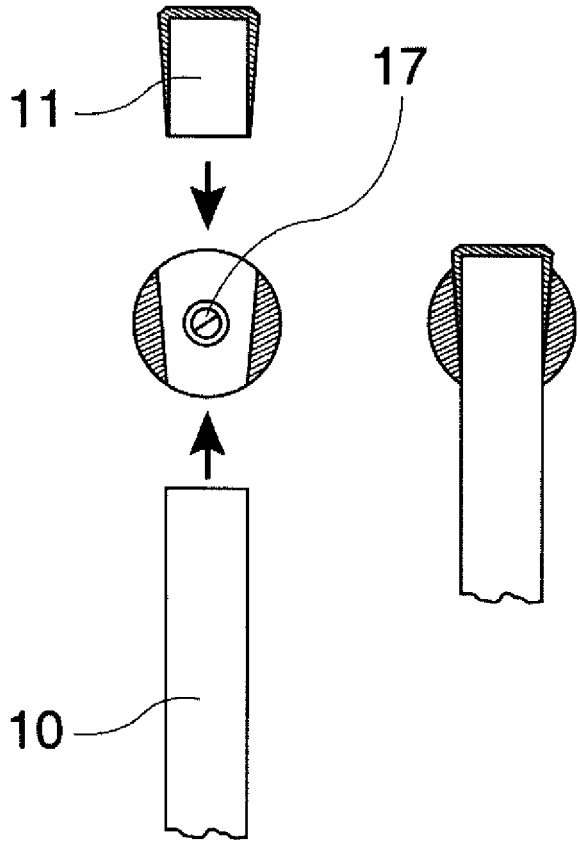
FIG. 3 is a view showing components for supporting the rod-shaped element on a part of the diverter.

The diverter 1 further has a supporting portion 16 which is also turnable relative to a diverter portion 15 around the diverter axis and fixable in a plurality of angular positions, for example by a screw 17 which can be tightened to fix a corresponding angular position. The supporting portion 16 of the diverter has an opening 8, which can have a conical shape shown in FIG. 3. A rod-shaped element 10 can be inserted into the conical opening 8 from below and tightly held in it by a conical plug 11 which fits over the upper end of the rod-shaped element 10 and is wedged in the opening 8.

The rod-shaped element 10 is elongated and a supporting member 12 can slide over it in a direction of elongation and also turn around its axis. The supporting member 12 has a U-shaped engaging part 13 in which the hand-held showerhead can be supported. In particular the end part 9 of the hose 6 of the hand-held showerhead 7 can be inserted into and held in the engaging part 13 of the supporting member 12. On the other hand, wherein the rod-shaped member 10 is removed from the opening 8 of the portion 16 of the diverter 1, the end part 9 of the hand-held showerhead 7 can be inserted into the opening 8 and the hand-held showerhead 7 can be held on the diverter 1.

The present invention is not limited to the details shown since various modifications and structural changes are possible without departing from the spirit of the invention.

What is desired to be protected by Letters Patent is set forth in particular in the appended claims:

1. A device for showering, comprising a water diverter connectable to a source of water: an overhead showerhead connected with said diverter and a handheld showerhead connected with said diverter so that said diverter can direct water to said showerhead or to said hand-held showerhead: and a rod-shaped-element which is held by said diverter and is provided with a supporting member supporting said hand-held showerhead in a position of non-use, wherein said diverter has an axis and a portion supporting said rod-shaped element and turnable around said axis so that said rod-shaped element supported by said supporting portion is also turnable around said axis of said diverter.

2. A device for showering as defined in claim 1, wherein said rod-shaped element is elongated, and said supporting member is displaceable on said rod-shaped element in a direction of its elongation and fixable in a plurality of positions.

3. A device for showering as defined in claim 2, wherein said rod-shaped element has an axis, and said supporting member is also turnable relative to said rod-shaped element around said axis of said rod-shaped element.

4. A device for showering as defined in claim 1, wherein said supporting portion of said diverter has an opening through which said rod-shaped element passes from below and which is substantially conical; and further comprising a substantially conical plug tightly insertable into said opening and fittable on an end of said rod-shaped element to firmly hold said rod-shaped element in said supporting portion of said diverter.

5. A device for showering, comprising a water diverter connectable to a source of water: an overhead showerhead connected with said diverter and a hand-held showerhead connected with said diverter so that said diverter can direct water to said overhead showerhead or to said hand-held showerhead: and a rod-shaped element which is held by said diverter and is provided with a supporting member supporting said hand-held showerhead in a position of non-use, wherein said diverter has a portion which alternatingly can receive in it either a part of said rod-shaped element or a portion of said hand-held showerhead to support correspondingly either said rod-shaped element or said hand-held showerhead.

* * * * *